US006930660B2

(12) United States Patent
Amemiya et al.

(10) Patent No.: US 6,930,660 B2
(45) Date of Patent: Aug. 16, 2005

(54) DISPLAY DEVICE

(75) Inventors: Isao Amemiya, Tokyo (JP); Kenichi Mori, Kanagawa (JP); Atsushi Sugahawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 317 days.

(21) Appl. No.: 10/242,633

(22) Filed: Sep. 13, 2002

(65) Prior Publication Data

US 2003/0052855 A1 Mar. 20, 2003

(30) Foreign Application Priority Data

Sep. 17, 2001 (JP) ..... 2001-282339

(51) Int. Cl.[7] ..... G09G 3/34
(52) U.S. Cl. ..... 345/85; 345/31; 345/108
(58) Field of Search ..... 345/31, 55–57, 345/108–110, 85, 34; 359/227; 40/473, 483, 493

(56) References Cited

U.S. PATENT DOCUMENTS 5,593,033 A * 1/1997 Kunreuther ..... 206/346
5,943,033 A 8/1999 Sugahara et al. ..... 345/85
6,239,777 B1 * 5/2001 Sugahara et al. ..... 345/85
6,618,034 B1 * 9/2003 Sugahara et al. ..... 345/109
6,697,035 B2 * 2/2004 Sugahara et al. ..... 345/85
6,753,845 B1 * 6/2004 Keeney et al. ..... 345/108

FOREIGN PATENT DOCUMENTS

JP 56-150786 11/1981
JP 06-208125 * 7/1994

* cited by examiner

*Primary Examiner*—Lun-yi Lao
(74) *Attorney, Agent, or Firm*—Oblon, Spivak, McClelland, Maier & Neustadt, P.C.

(57) ABSTRACT

The present invention provides a display device formed with an array of a plurality of pixels, which comprises: fixed elements with surfaces colored a first color, the fixed elements being arranged in correspondence with the pixels; movable elements with surfaces colored a second color, the movable elements being arranged in correspondence with the pixels; support elements supporting the movable elements at first ends thereof, the support elements being rotatable; and a inclined angle changing device configured to contact second ends of the support elements to change the inclined angle of the support elements; wherein, changing the inclined angles of the support elements allows the movable elements to move between rear surfaces of the fixed elements and adjacent front surfaces of the fixed elements.

12 Claims, 11 Drawing Sheets

DISPLAY DEVICE

CROSS REFERENCE TO RELATED APPLICATION

This application is based upon and claims the benefit of priority from the prior Japanese Patent Application No. P2001-282339, filed on Sep. 17, 2001; the entire contents of which are incorporated herein by reference.

BACKGROUND OF THE INVENTION

1. Field of the Invention

This invention relates to a display device which displays image information in the form of an array of a plurality of pixels, and more particularly, to a display device having a mechanical structure which allows rewrites of images.

2. Description of the Related Art

Display devices for exhibiting image information formed with an array of a plurality of pixels includes a non-light emitting display device without an light-emitting means. The non-light emitting display device is widely used in large-screen displays to exploit its energy-saving advantage resulting from not including any light-emitting means. A typical type of such a large non-light emitting display device includes a magnetic rotary display device in which spheres or cubes with differently-colored sides are arranged in correspondence with pixels and are magnetically rotated to switch their exposed faces, thereby representing their respective pixels. There is also a similar type in which micro capsules containing magnetic material are magnetically moved and rotated to represent their respective pixels.

In these types, however, the exposed faces of the spheres, cubes, micro capsules or the like are switched to represent the respective pixels, resulting in the display of limited colors, usually four colors.

As a solution to the problems with these types, Japanese Patent Laid-Open Publication No. SHO-56-150786 presents a color film display device having a plurality of color films stacked on one another for display. This display device has a means for sliding the color films, configured to utilize attraction and repulsion between permanent magnets and electromagnets or configured to mechanically slide the color films with a rotating wheel brought into contact therewith.

The sliding means of these configurations cannot independently slide one of the stacked color films. The combination of multiple sliding operations is thus required to slide a film to an intermediate position. Further, the configuration utilizing magnetic force requires highly precise control of electromagnetic force, causing difficulty in fixing the color films in their respective accurate positions and the possibility of interference with a color film in an adjacent display unit. Further, the mechanical sliding configuration requires the provision of another mechanical sliding means facing the front display surface, resulting in a complicated structure.

The present inventors have presented a actuated film display device of a type in which color films are mounted to the distal ends of cantilevers which are displaced by electrostatic force to slide the color films (e.g., Japanese Patent Laid-Open Publication No. HEI-8-271933).

This actuated film display device of the cantilever structure has, as shown in FIG. 1, fixed films 91 colored white, for example, placed in a tiled roof-like arrangement, and actuated films 92 colored black or another color to be moved out through the gaps. The fixed films 91 are fixed by first support films 93. The actuated films 92 are attached on second support films 94. The second support films 94 are selectively bent by use of electrostatic force generated with fixed electrodes 95 to change a display image.

Although the above type of display device utilizing electrostatic force as driving force, being configured to apply voltage between the individual second support films and the fixed electrodes, is effective for the display type of switching the display pixels individually or simultaneously, the resulting wiring of electrodes is complicated. Further, the above type requires the stable maintenance of the potential of each electrode in order to maintain the display of a fixed image, resulting in an increase in consumption power.

For a display device displaying fixed image information such as tariffs and schedules in stations for a long time with very low frequency of rewriting of the image information, a more simple and power-saving image rewriting means is required.

BRIEF SUMMARY OF THE INVENTION

The present invention has been made to solve the above problems, and has an object of providing a simple and power-saving display device through the prevention of structural complication due to electrode wiring or the like and the reduction of power for maintaining the display of a fixed image.

According to an aspect of the present invention, there is provided a display device formed with an array of a plurality of pixels, which comprises: fixed elements with surfaces colored a first color, the fixed elements being arranged in correspondence with the pixels; movable elements with surfaces colored a second color, the movable elements being arranged in correspondence with the pixels; support elements supporting the movable elements at first ends thereof, the support elements being rotatable; and a inclined angle changing device configured to contact second ends of the support elements to change the inclined angles of the support elements; wherein, changing the inclined angles of the support elements allows the movable elements to move between the rear surfaces of the fixed elements and the adjacent front surfaces of the fixed elements.

DETAILED DESCRIPTION OF THE INVENTION

Figure 1:
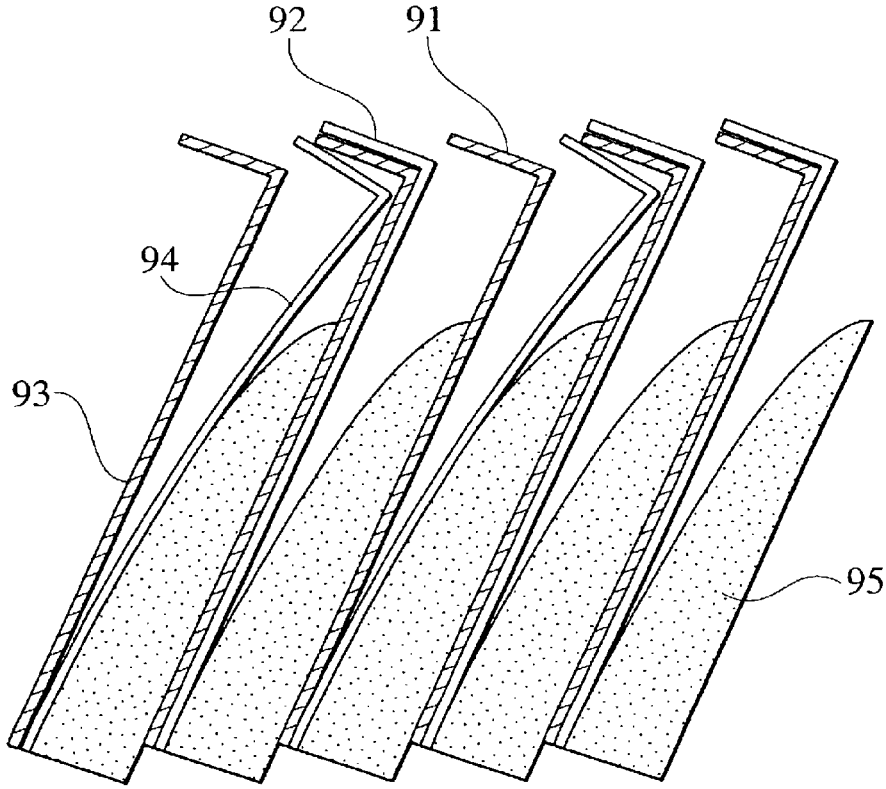
FIG. 1 is a cross-sectional view of a conventional actuated film display device.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Generally and as it is conventional in the representation of devices, it will be appreciated that the various drawings are not drawn to scale from one figure to another nor inside a given figure.

In the following descriptions, numerous specific details are set forth to provide a through understanding of the present invention. However, it will be obvious to those skilled in the art that the present invention may be practiced without such specific details.

First Embodiment

Figure 2:
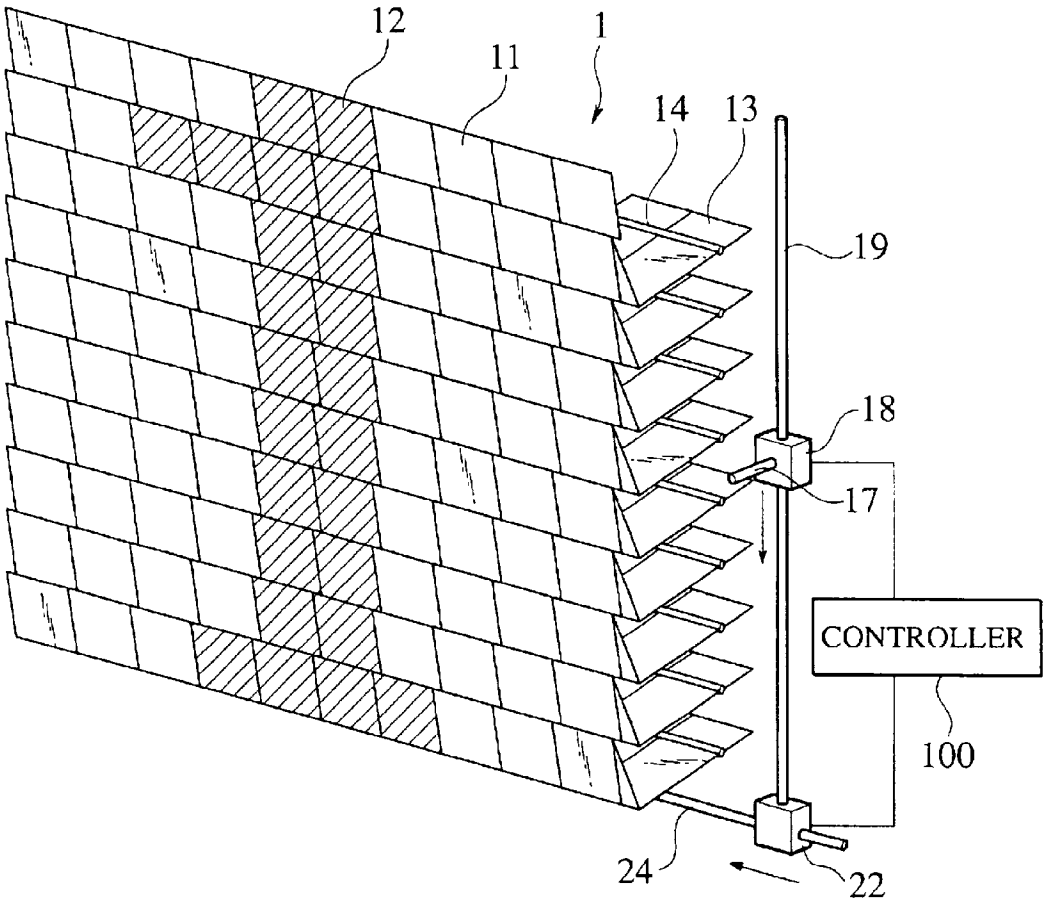
FIG. 2 is a perspective view of a display surface of a display device according to a first embodiment of the present invention.
Figure 3:
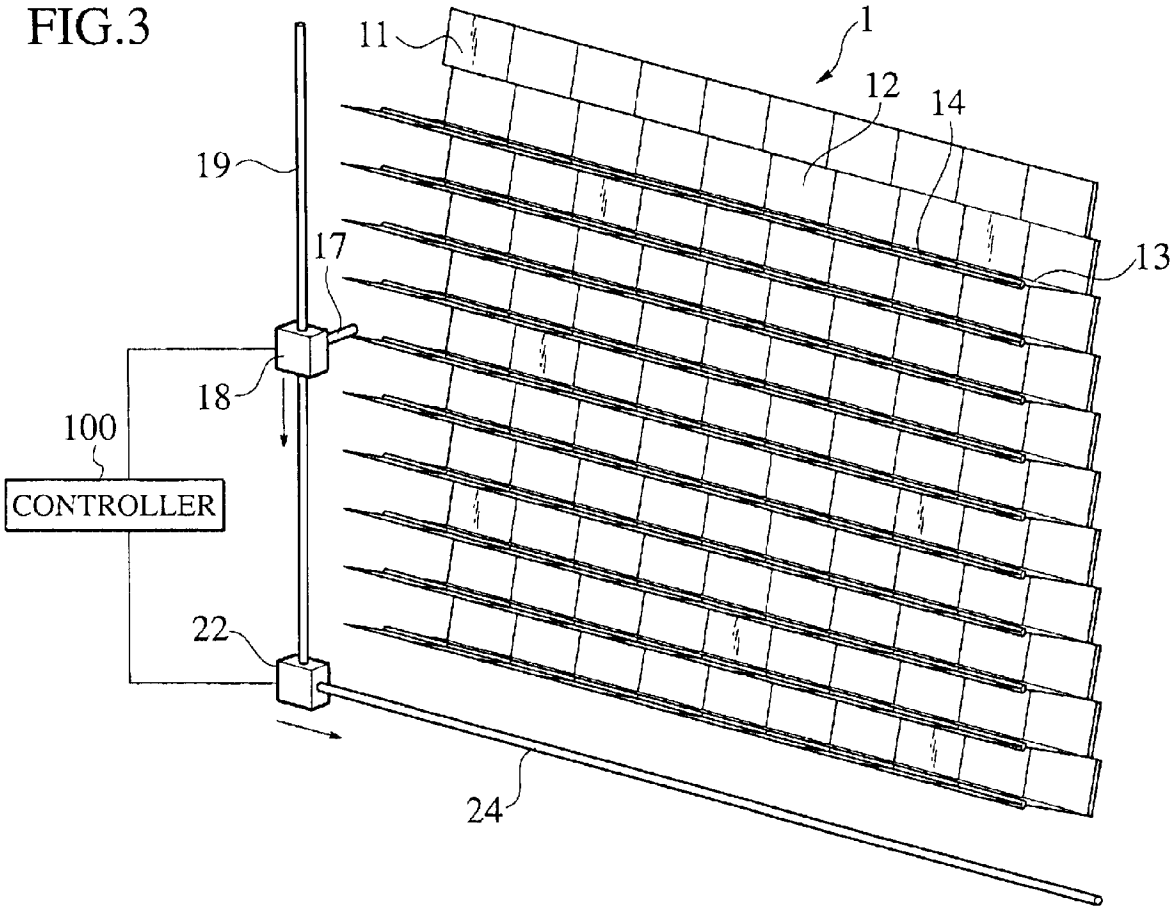
FIG. 3 is a perspective view of a rear inner surface of the display device according to the first embodiment of the present invention.

A display device according to a first embodiment of the present invention will be described. FIG. 2 illustrates the appearance of the display device of this embodiment. FIG. 3 illustrates the appearance of a display unit 1 viewed from the rear. The display device of this embodiment includes the display unit 1 displaying image information and a controller 100 controlling the operation of the display unit 1.

The display unit 1 includes fixed films (fixed elements) 11 arranged in correspondence with pixels, with the front surfaces colored a first color, actuated films (movable elements) 12 arranged in correspondence with the pixels, with the front surfaces colored a second color, rotatable support films (support elements) 13 supporting the actuated films 12 at their first ends, and a inclined angle switching device 18 as a inclined angle changing device which is brought into contact with the second ends of the support films 13 to change the inclined angles thereof.

The fixed films 11 are colored the first color, e.g., white, in this embodiment, and individually arranged at a fixed inclination angle like tiles on a roof, to form the display surface of the display unit 1. The fixed films 11 are not necessarily required to be individually independently arranged and may be connected into rectangular films like those of a venetian blind.

Figure 4B:
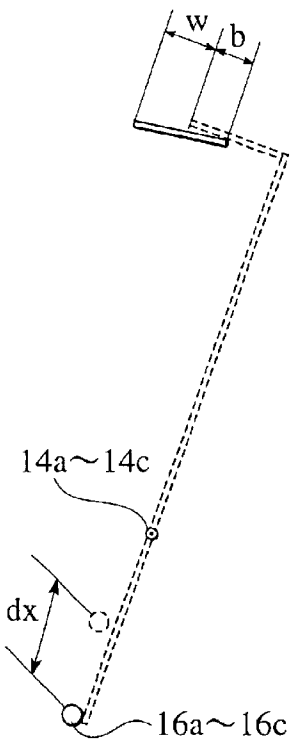
FIGS. 4A and 4B are explanatory views illustrating the principles of operation in the first embodiment of the present invention.
Figure 4A:
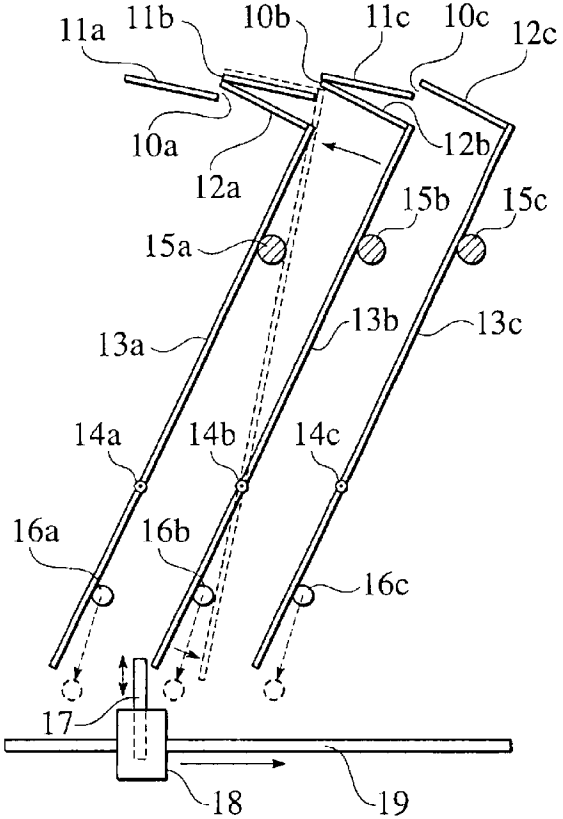

The actuated films 12 in this embodiment are colored the second color, e.g., black, moved in and out through the gaps between the adjacent fixed films 11 and stacked on the surfaces of the fixed films 11. More specifically, as shown in FIG. 4A, actuated films 12*a* to 12*c* are inserted or withdrawn from the rear of fixed films 11*a* to 11*c* through gaps 10*a* to 10*c* between the adjacent fixed films 11*a* to 11*c*. When inserted, the actuated films 12*a* to 12*c* cover the surfaces of the fixed films 11*a* to 11*c*. The actuated films 12*a*, 12*b* and 12*c* are connected at their first ends to support films 13*a*, 13*b* and 13*c* as the substantially vertical support thereof.

The principle of switching display colors will be described with reference to FIGS. 4A and 4B. In FIG. 4A, three pixels are aligned. When the support film 13*b* is largely inclined on a fulcrum 14*b* at the middle pixel, the actuated film 12*b* fixed at the distal end thereof hides behind the adjacent fixed film 11*c*, and the first color of the fixed film 11*b*, white, is shown. When the support film 13*b* is tilted up substantially vertically and the actuated film 12*b* fixed to the distal end thereof is stacked on the surface of the fixed film 11*b* as shown by broken lines in FIG. 4A, the second color of the actuated film 12*b*, black, is shown.

Although the actuated film 12 and the support film 13 are connected to one another at their ends in this embodiment, they may be integrally formed with the same material and bent at an approximately right angle. In this case, at least a actuated film portion to be stacked on the surface of a fixed film 11 colored a first color should be colored a second color. Alternatively, a colored actuated film 12 may be bent at an approximately right angle and fixed to a side surface of a support film 13.

The support films 13 (13*a*, 13*b* and 13*c* in FIG. 4A) rotate about the fulcrums 14*a*, 14*b* and 14*c*. The rotation of the support films 13 causes the actuated films 12 to be inserted or withdrawn through the gaps 10*a* to 10*c*. Each fulcrum 14 is provided at a position closer to the end of each support film 13 opposite to the end at which the actuated film 12 is fixed. Thus positioning the fulcrum 14 closer to the lower end opposite to the front end with the actuated film 12 fixed thereto allows a large displacement of the actuated film 12 with a small displacement of the lower end. The value is desirably from two times to five times in view of weight balance.

In this embodiment, the distance between the fulcrum 14 and the actuated film 12 is twice the distance between the opposite end and the fulcrum 14. Thus the amount of displacement required for the actuated film 12 is achieved by moving the lower end half the amount of the displacement.

Figure 5A:
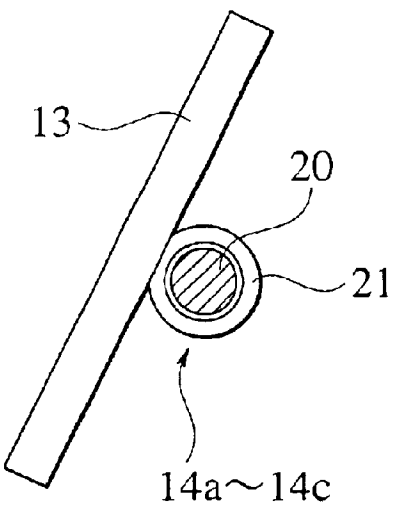
FIGS. 5A to 5C are cross-sectional views of exemplary structures around a fulcrum of a support film according to the first embodiment of the present invention.
Figure 5B:
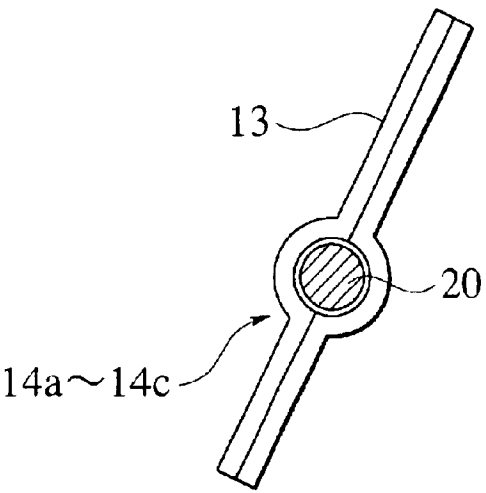
Figure 5C:
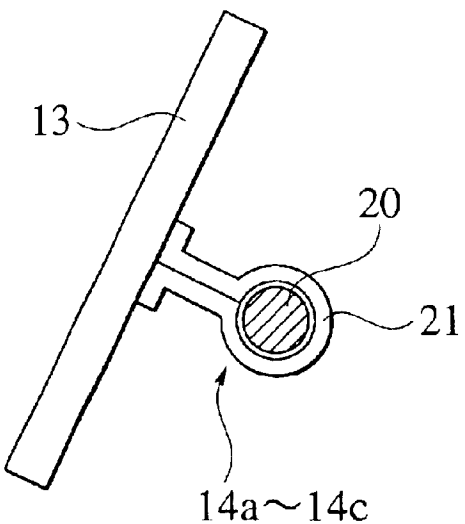

The form of the fulcrum 14 can be variously modified. FIGS. 5A to 5C are structural examples, illustrating more details of the surroundings of a fulcrum 14 of a support film 13. Specifically, in FIG. 5A, a cylindrical film 21 in a tube-like shape is put on the circumference of a metal rod 20 constituting a rotation axis and the support film 13 is connected to the cylindrical film 21.

In FIG. 5B, a support film 13 consists of two films which are deformed to enclose a metal rod 20 constituting a rotation axis. In FIG. 5C, a cylindrical film 21 is put on the circumference of a metal rod 20 constituting a rotation axis in a manner substantially identical to that in FIG. 5A. The support film 13 is, however, connected to the cylindrical film 21 at a distanced position from the metal rod 20. The structure of FIG. 5C increases the turning radius of a actuated film 12 fixed to the distal end of the support film 13, allowing the insertion and withdrawal of the actuated film 12 with less change in inclined angle.

The material of the fixed films 11, actuated films 12 and support films 13 may be polymer films made of, for example, polyethylene terephthalate (PET), polyethylene naphthalate (PEN), polyphenylene sulfide (PPS), polyether sulfone (PES), polyimide (PI), Aramica (R) (polyaramid), polyetherimide (PEI), or polycarbonate (PC), or metal sheets or alloyed metal sheets.

In this embodiment, the actuated films 12*a* to 12*c* are provided with block bars 15*a*, 15*b* and 15*c* for limiting the inclined angles thereof as shown in FIG. 4A. The block bars 15*a*, 15*b* and 15*c* are bar-like members disposed in parallel with the rotation axes of the fulcrums 14*a* to 14*c*. The block bars 15*a*, 15*b* and 15*c* are positioned to stop the inclination of the actuated films 12*a*, 12*b* and 12*c* when the actuated films 12*a* to 12*c* fixed to the distal ends of the support films 13*a* to 13*c* are inclined to positions completely hidden behind the adjacent fixed films without interfering the displaying operations of the adjacent support films.

When the support films 13 are rotated to entirely stack the actuated films 12 over the fixed films 11, the distal ends of the support films 13 abut against ends of the fixed films 11 and stop their motions. The block bars 15 are positioned to be in contact with the support films 13 raised up (as shown by broken lines in FIG. 4A). The block bars 15 thus limit the range of inclined angles of the support films 13. The cross-section of the block bars 15 may be quadrangular or triangular instead of circular as shown in FIG. 4A.

Movable brake bars 16*a*, 16*b* and 16*c* for fixing and maintaining the inclined angles of the support films 13*a*, 13*b* and 13*c* are disposed below the fulcrums 14*a*, 14*b* and 14*c*. The movable brake bars 16 are lowered to positions shown by dotted lines in FIG. 4A when the inclined angles of the support films 13 are changed. In the positions after being moved, the movable brake bars 16 do not contact the support films to avoid interfering the rotation thereof. When the operation of switching the inclined angles of the support films 13 is completed, the movable brake bars 16 are raised to the original fixed positions to fix the positions of the support films 13. This allows the mechanical maintenance of the inclined angles of the support films 13 not using electromagnetic force but by using the brake bars 16, resulting in reduction in power required to maintain a display image.

The original fixed positions of the movable brake bars 16 are positions in which the movable brake bars 16 are in contact with the support films 13 either with maximum inclined angles at which the actuated films 12 fixed to the distal ends of the support films 13 are completely hidden behind the fixed films 11 or with minimum inclined angles at which the actuated films 12 fixed to the distal ends of the support films 13 lie entirely over the fixed films 11. If the support films 13 stop at unstable intermediate inclined angles, the upward returning movements of the movable brake bars 16 to the fixed positions push and rotate the support films 13 to positions with the desired maximum or minimum inclined angles. The cross-section of the movable brake bars 16 may be quadrangular or triangular instead of circular as shown in FIGS. 4A and 4B.

Figure 6A:
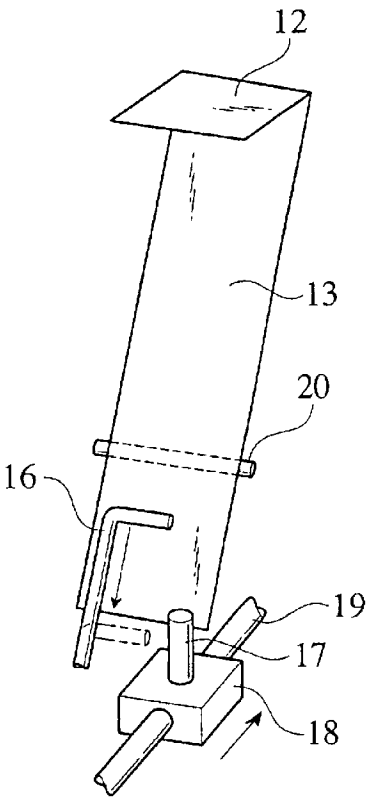
FIGS. 6A to 6C are perspective views of exemplary structures of a brake bar and the surroundings according to the first embodiment of the present invention.
Figure 6B:
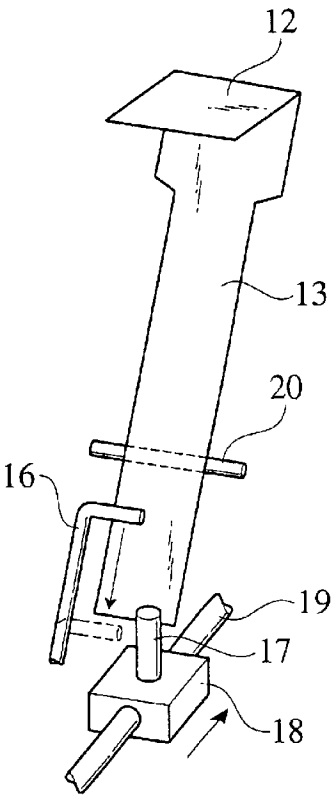
Figure 6C:
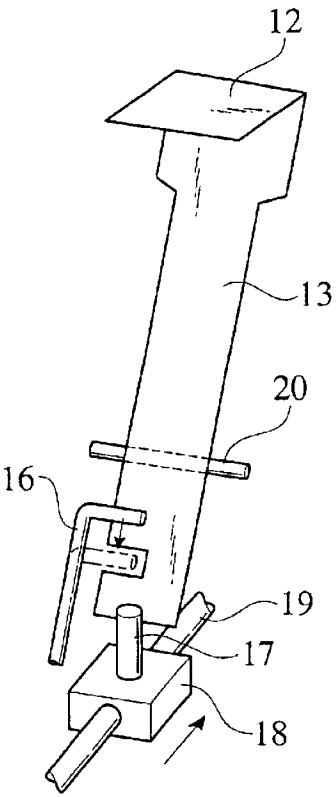

FIGS. 6A to 6C illustrate the structure and movement of the brake bar 16 and the surroundings, the structure and movement of the inclined angle switching device 18 and the positional relationship therebetween. As will be described below, the inclined angle switching device 18 moves along a guide while selectively rotating the support films 13 by protruding or not protruding a movable rod 17.

In the example of FIG. 6A, the movable brake bar 16 is in a reverse L shape and has a mechanism to move down to a lower position shown by dotted lines to avoid contact with the support film 13 immediately before the movable rod 17 of the inclined angle switching device 18 is brought into contact with the lower end of the support film 13. The movable brake bar 16 moves up and down in a position to avoid interference with the movable rod 17 of the inclined angle switching device 18 in motion.

In the example of FIG. 6B, as compared with the structure of FIG. 6A, the width of the support film 13 is a little smaller than the width of the actuated film 12. In a space saved by the smaller width, a longitudinal-bar portion of the movable brake bar 16 in a reverse L shape is positioned. This structure limits the portion of the movable brake bar 16 overlapping the support film 13 to a cross-bar portion, increasing the degree of freedom in up-and-down movements of the movable brake bar 16, and improving the precision in fixing the position of the support film 13.

In the example of FIG. 6C, as compared with the structure of FIG. 6B, a lower portion of the support film 13 below the metal rod 20 is provided with a cut of a sufficient size to allow the cross-bar portion of the movable brake bar 16 to pass therethrough. The movable brake bar 16 has a mechanism to move down to the cut portion immediately before the movable rod 17 of the inclined angle switching device 18 is brought into contact with the lower end of the support film 13. In this structure, less up-and-down movements of the movable brake bar 16 enables the rotatable state of the support film 13. This increases the degree of freedom in position in which the movable rod 17 of the inclined angle switching device 18 contacts the support film 13, eliminating the need to necessarily distance the movable rod 17 from the movable brake bar 16.

Further, the present embodiment allows stepwise adjustment of the inclined angle of each support film 13 through changing the stopping position of the movable brake bar 16 to an upper or a lower position. More specifically, as shown in FIG. 4B, the stopping positions of the movable brake bars 16*a* to 16*c* change from the solid line position to the dotted line position. Travel distance dx is appropriately changed to adjust the overlap width b of the actuated films 12 with respect to the fixed films 11. This adjusts the area of the actuated films 12 overlapping the fixed films 11. The ratio between the exposed width w of the fixed films 11 and the overlap width b of the actuated films 12 is changed to allow halftone display in area. Similarly, changing the stopping position of the movable brake bars 16 to a forward or backward position enables the adjustment of the inclined angles of the support films 13 in accordance with the densities of the corresponding pixels.

The inclined angle switching device 18 is disposed in the vicinity of the free ends of the support films 13 opposite to the fixed ends thereof to which the actuated films 12 are fixed. The inclined angle switching device 18 moves along an array of the support films 13, selects support films 13 in accordance with image information, and changes the inclined angles of the selected support films 13.

More specifically, the inclined angle switching device 18 in this embodiment is arranged behind the display device as shown in FIGS. 2 and 3, and is moved in a Y-axis direction (column direction) and a X-axis direction (row direction) along guides 19 and 24. That is, the inclined angle switching device 18 moves along the guide 19 in the column direction of the display unit 1 while selectively changing the inclined angles of the support films 13 in accordance with the image information. At the end of each column, the guide 19 is slid along the guide 24 in the x-axis direction, sequentially changing the position of the inclined angle switching device 18 with respect to the display unit 1, thereby rewiring the entire display image of the display device.

Thus the locomotive faculty of the inclined angle switching device 18 is utilized to move the free ends of the selected support films 13 for rotation of the support films 13 on the rotation axes. This rotation moves the actuated films 12, allowing the mechanical change of display colors. The number of the inclined angle switching device 18 is not limited to one and a plurality of such inclined angle switching devices may be provided inside the display panel.

The selection of the support films 13 in accordance with image information is performed by the movable rod 17. The movable rod 17 is provided in the side of the inclined angle switching device 18 facing the display unit 1. The movable rod 17 is advanced or retracted so as to be contacted with or distanced from the free ends of the support films 13, selecting the support films 13 to be changed in inclined angles.

More specifically, as shown in FIG. 4A, the inclined angle switching device 18 protrudes the movable rod 17 for contact with the free end of the support film 13*b* largely inclined in the middle of the display unit and pushes the free end to reduce the inclination of the support film 13*b*. Then, as shown by dotted lines in the figure, the movable rod 17 is distanced to a position which avoids contact with the support film 13 when or immediately before the actuated film 12*b* fixed to the distal end lies entirely over the fixed film 11*b*. This operation switches the display color from white to black.

Conversely, to change a pixel from black to white, the travel direction of the inclined angle switching device 18 is reversed and the movable rod 17 performs the same operation. While the movable rod 17 is in contact with the support film 13, the movable brake bar 16 is moved down to a position which avoids contact with the support film 13 and waits in the position. The movement of the movable brake bar 16 is mechanically associated with the movement of the inclined angle switching device 18 along the guide 19. A component for moving the movable rod 17 up and down is, e.g., in the form of a solenoid causing mechanical movement with electromagnetic force.

In this embodiment, as shown in FIGS. 2 and 3, the fixed films 11 are aligned in a vertical direction and the display unit 1 is provided in a standing manner. With the display unit 1 thus raised, the support films 13 lie horizontally with the distal ends to which the actuated films 12 are fixed lowered. To move the support films 13 with the inclined angle switching device 18, great power is required against gravity. Thus the present embodiment makes an adjustment to provide weight balance to the support films 13 in both directions with respect to the fulcrums.

This enables the movement of the support films 13 with less power. It is more preferable that the weight balance be achieved in an approximately intermediate position between the position of the support film 13 to display white and the position of the support film 13 to display black. Setting the weight balance in a manner that the support films 13 tend to incline toward the position of displaying white enables the automatic operation of returning the display to white by gravity only by moving the movable brake bars 15 to make the support films 13 rotatable. In this case, the moving operation of the support films 13 by the inclined angle switching device 18 is required only for black display, leading to power saving. This is also advantageous for the operation of simultaneous reset of the entire display. Also in the case of enabling halftone display by shifting the stopping positions of the movable brake bars 16, it is advantageous to set the weight balance in a manner that the support films 13 tend to incline toward the position of displaying white.

Figure 7:
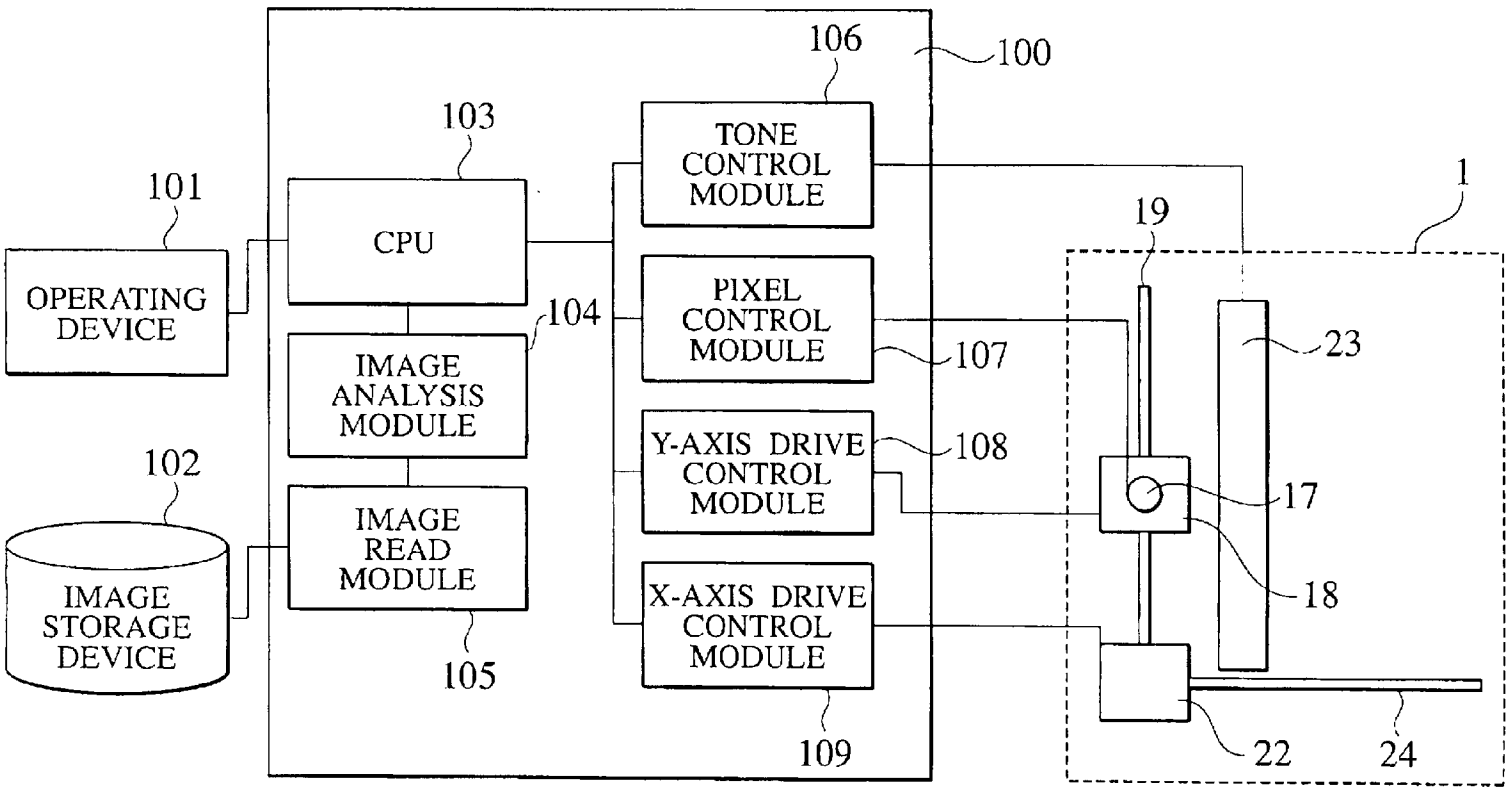
FIG. 7 is a block diagram of an internal structure of a controller in the display device according to the first embodiment of the present invention.

The operation of the display unit 1 having the above structure is controlled by a controller 100 shown in FIG. 7. As shown in FIG. 7, the controller 100 includes an operating device 101 to be operated by an operator and an image storage device 102 storing image information to be displayed. When the operating device 101 indicates an image to be displayed, the image storage device 102 reads the image to display it on the display unit 1.

The controller 100 has, as is shown in FIG. 7, a central processing unit 103 for various processing to control the operation of each unit, an image read module 105 as an interface for reading an image from the image storage device 102, and an image analysis module 104 for analyzing the read image. The image analysis module 104 analyzes the coordinate positions and colors of the pixels of the read image and sends the analysis to the central processing unit 103. In accordance with the analysis, the central processing unit 103 sends control signals to a tone control module 106, a pixel control module 107, a Y-axis drive control module 108 and an X-axis drive control module 109 which control the respective mechanisms of the display unit 1.

The tone control module 106 controls the display densities of the pixels, and more specifically, controls the drive of an adjustment device 23 which adjusts the stopping positions of the movable brake bars 16. The pixel control module 107 controls the display colors of the pixels, and more specifically, controls the advancement and retraction of the movable rod 17, selecting pixels of display colors to be changed. The Y- and X-axis drive control modules 108 and 109 control the movement of the inclined angle switching device 18, and more specifically, control the rotational drive of the guides 19 and 24, controlling the positions of coordinates of the inclined angle switching device 18 and an X-axis drive member 22 with respect to the display unit 1.

With this display device, when an operator instructs the display of an image at the operating device 101, the image is read from the image storage device 102 and processed by the central processing unit 103. Thereafter the control units 106 to 109 start operating the respective mechanisms in the display unit 1. Specifically, the inclined angle switching device 18 starts scanning behind the display unit 1 and sequentially adjusts the inclined angles in positions opposed to the support films 13 of display colors (densities) to be switched.

The present embodiment allows the switching of image information with simple structures and mechanisms, achieving a reduction in manufacturing cost. Further this embodiment fixes a display image with the mechanical structure, allowing the stable maintenance of displayed image information for a long time, and thereby achieving power saving.

Second Embodiment

Figure 8:
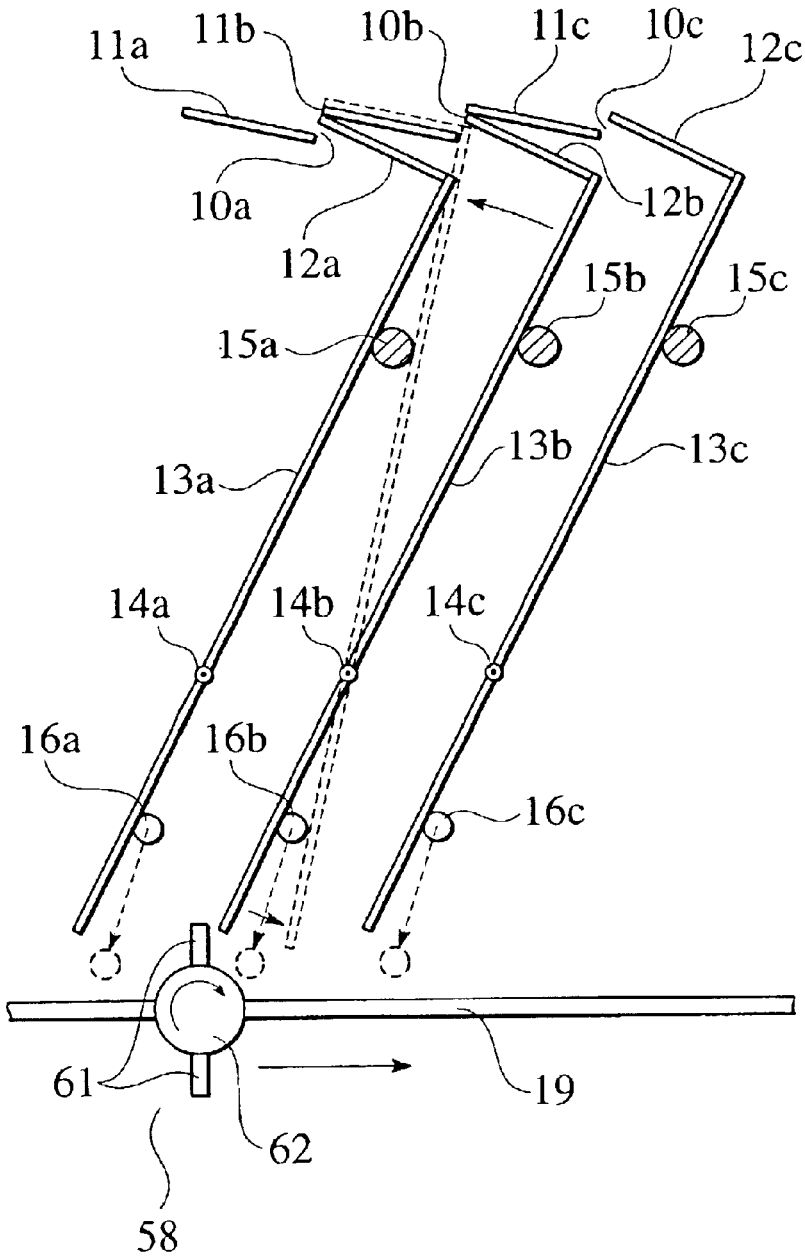
FIG. 8 is an explanatory view illustrating the principle of operation in a second embodiment of the present invention.

Now a second embodiment of the present invention will be described. This embodiment modifies the configuration of the inclined angle switching device in the above-described first embodiment. FIG. 8 shows a inclined angle switching device 58 according to this embodiment.

The inclined angle switching device 58 of this embodiment has a rotatable cylindrical drum 62 with protrusions 61 on the periphery as shown in FIG. 8. The protrusions 61 are selectively brought into contact with the free ends of support films 13 by the rotation of the cylindrical drum 62. The cylindrical drum 62 is rotatable in both forward and backward directions with respect to the moving direction of the inclined angle switching device 58.

To change a pixel from white to black by changing the inclined angle of a support film 13*b* using the inclined angle switching device 58, the inclined angle switching device 58, while moving along a guide 19, rotates the cylindrical drum 62 in a direction identical to the traveling direction of the inclined angle switching device 58 so that the protrusion 61 stands vertically with respect to the moving direction, thereby setting the protrusion 61 in a position which contacts a free end of the support film 13*b*.

When the protrusion 61 contacts the support film 13*b* and rotates it to a predetermined inclined angle (to a position shown by dotted lines in the figure), the cylindrical drum 62 is rotated to prevent the protrusion 61 from contacting the free end of the support film 13*b*. When the inclined angle of the support film 13*b* does not need to be changed, the two protrusions 61 remain in positions which avoid contact with the free end of the support film 13*b*.

Figure 9:
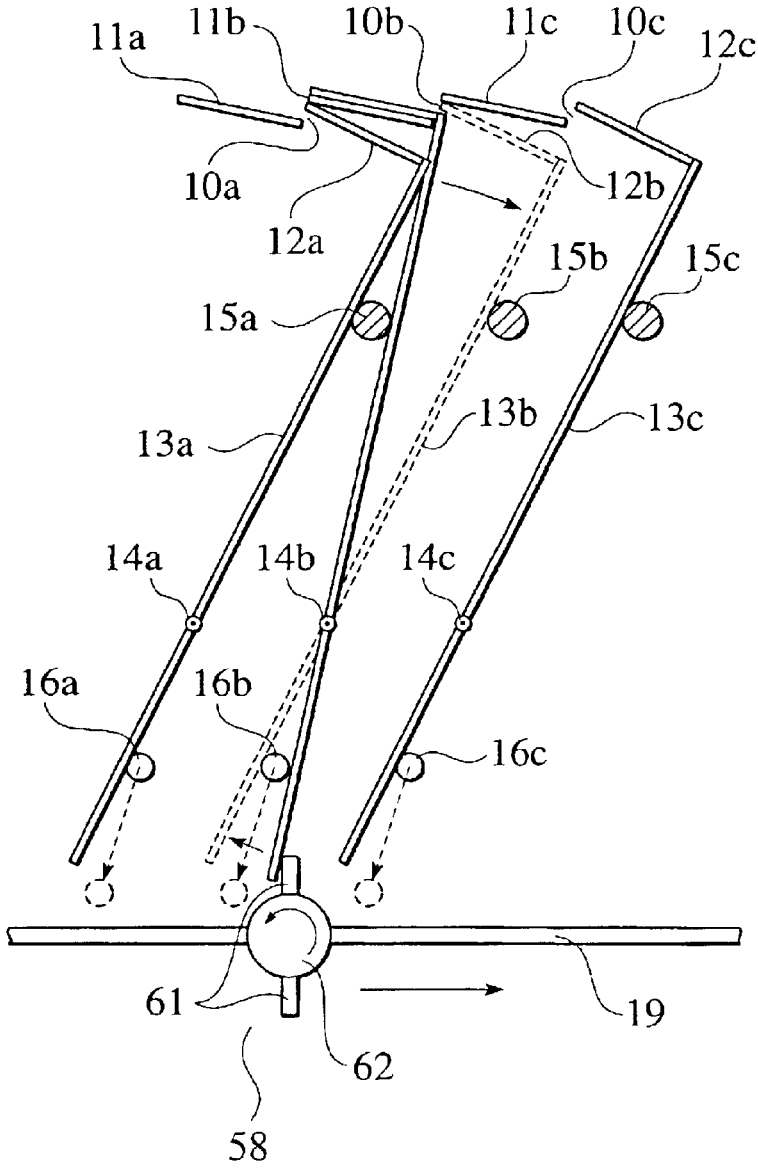
FIG. 9 is an explanatory view illustrating the principle of operation in the second embodiment of the present invention.

The present embodiment provides the two protrusions 61 in symmetric positions, allowing the repeated switching of the inclined angles of the support films 13 by a half rotation. Conversely, to change the display from black to white, the moving direction of the inclined angle switching device 18 along the guide 19 is reversed and also the rotation direction of the cylindrical drum 6 is reversed. Alternatively, as shown in FIG. 9, the cylindrical drum 62 may be rotated at high speed in a direction opposite to the moving direction of the inclined angle switching device 58 so as to change the display from black to white. In this case, movable brake bars 16 preferably correct the positions of the support films 13.

With the cylindrical drum 62 rotatable in opposite directions, moving the inclined angle switching device 58 in one direction enables changing the inclined angle of the support films 13 to an opposite direction. The forward and backward movement of the inclined angle switching device 18 and the rotation of the cylindrical drum 62 can cause the movable brake bars 16 and the protrusions 61 to selectively contact the free ends of the support films 13, resulting in the selection of the support films 13 with inclined angles to be changed, using the mechanical structures.

Only changing the rotation direction of the cylindrical drum 62 switches the moving direction of the free ends of the support films 13, leading to a reduction in the travel distance of the inclined angle switching device 18 and the simplification of the drive mechanism, thus reducing the complexity of the device. The inclined angle switching device 58 may be provided with two individual cylindrical drums 62 with opposite rotation directions.

The present embodiment enables switching of image information with a simple structure and mechanism, resulting in a reduced manufacturing cost of the device. Fixing a display image by means of the mechanical structure allows the stable maintenance of displayed image information for a long time, resulting in power saving.

Third Embodiment

Figure 10:
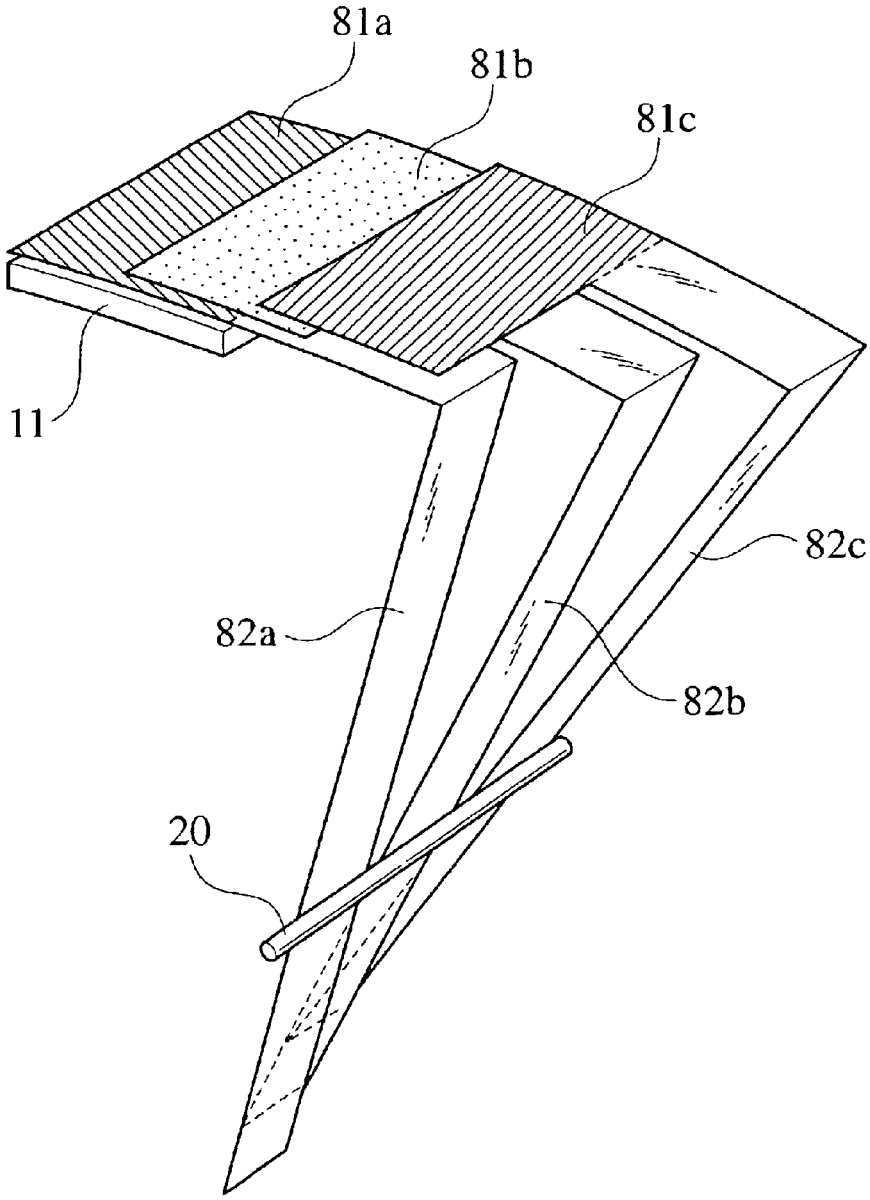
FIG. 10 is an explanatory view of a display device according to a third embodiment of the present invention.

Now a third embodiment of the present invention will be described. FIG. 10 illustrates the configuration of each film according to this embodiment. FIG. 10 only shows actuated films and support films, with other components identical to those in the first and second embodiments omitted.

The third embodiment provides a plurality of actuated films in the first and second embodiments to a single fixed film. The actuated films are colored differently. Specifically, as shown in FIG. 10, the actuated films of different colors are stacked on the same fixed film for mixed color display, constituting a color display unit.

The color display unit has three actuated films 81*a*, 81*b* and 81*c* for a single fixed film 11. The actuated films 81 are transparent films and are colored yellow, magenta and cyan. Support films 82*a*, 82*b* and 82*c* corresponding to the actuated films 81*a*, 81*b* and 81*c* are individually operated to display various colors on the fixed film 11, further improving the color expression of the display unit 1. A inclined angle switching device not shown is provided with three inclined angle switching rods or cylindrical drums with protrusions which are independently operated in correspondence with the support films 82*a*, 82*b* and 82*c*.

When the above-described polymer films are used for the actuated films of different colors used in the third embodiment to be stacked for mixed color, achromatic and transparent PET, PEN, PES and the like are preferable, which are preferably colored in desired colors using pigment or colorant.

The present embodiment enables the switching of image information using a simple structure and mechanism, leading to the reduced manufacturing cost of the device. Fixing a display image by means of the mechanical structure allows displayed image information to be maintained stably for a long time, resulting in power saving.

Fourth Embodiment

Figure 11A:
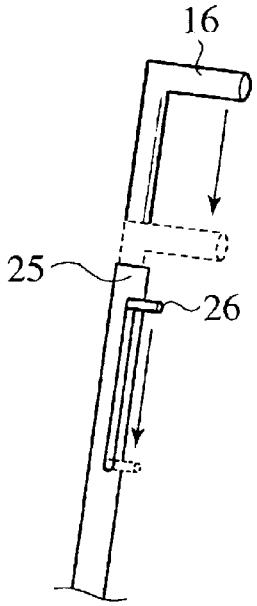
FIGS. 11A to 11C are explanatory views illustrating the principle of operation in a fourth embodiment of the present invention.
Figure 11B:
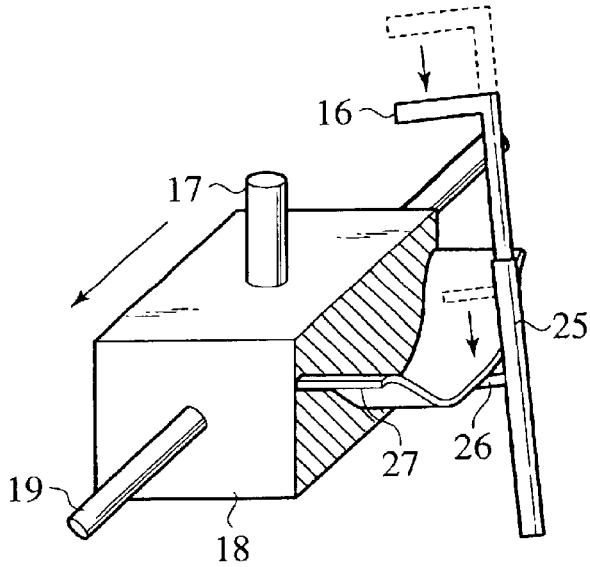
Figure 11C:
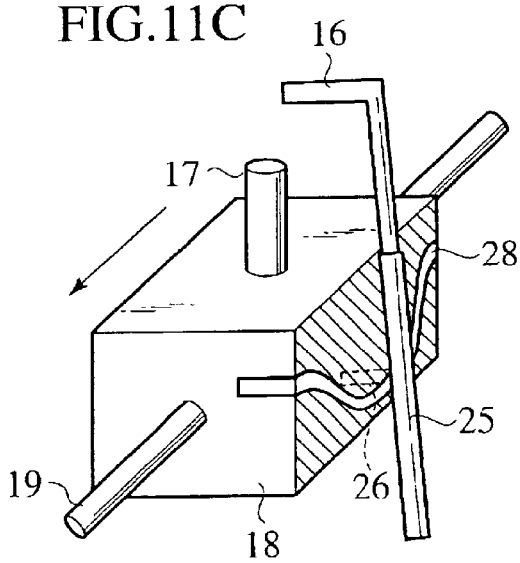

Now a fourth embodiment of the present invention will be described. This embodiment modifies the drive mechanisms of the movable brake bars 16 and the inclined angle switching device 18 of the first embodiment. FIGS. 11A to 11C illustrate a mechanism for the up-and-down movements of a movable brake bar according to this embodiment. FIG. 11A to 11C show a movable brake bar 16, a inclined angle switching device 18 and the surroundings, with other components identical to those of the first and second embodiment omitted.

The movable brake bar 16 is arranged to be advanced into or withdrawn from a position which maintains the inclined angle of a support film 13 in conjunction with the movement of the inclined angle switching device 18. The movable brake bar 16 and the inclined angle switching device 18 are provided with a control mechanism to advance or withdraw the movable brake bar 16 in conjunction with the movement of the inclined angle switching device 18 along an array of support films 13. The control mechanism includes a rail 27 in a curved shape and a pin 26 controlling the up-and-down movements of the movable brake bar 16 in this embodiment. The principle of operation of this embodiment will be described in detail below.

As shown in FIG. 11A, a lower portion of a main shaft of the movable brake bar 16 is housed in a tube 25. The movable brake bar 16 is constantly biased in a protruding direction by a spring contained in the tube 25. A slit is provided in a side surface of the tube 25 in parallel with the up-and-down movement direction of the movable brake bar 16. The pin 26 fixed to the main shaft of the movable brake bar 16 is protruded from the slit. The movable brake bar 16 moves in conjunction with the upward or downward movement of the pin 26. The pin 26 is disposed in the travel line of the inclined angle switching device 18 at a level which contacts a lower surface of the rail 27.

More specifically, as shown in FIG. 11B, the movable brake bar 16 has a mechanism with which the rail 27 pushes the pin 26 downward, moving downward in conjunction with the movement of the pin 26. When the pin 26 is released by the movement of the rail 27, the positions of the pin 26 and the movable brake bar 16 are returned to the uppermost positions by the spring provided inside the tube 25.

The movable brake bar 16 with such a mechanism interlocks the inclined angle switching device 18 to automatically move up and down with the movement of the inclined angle switching device 18 along the guide 19 as shown in FIGS. 11B and 11C. Specifically, the traveling of the inclined angle switching device 18 causes the pin 26 of the movable brake bar 16 to move under the lower surface of the rail 27, and the positions of the pin 26 and movable brake bar 16 move up and down in accordance with the shape of the rail 27.

More specifically, the pin 26 first moves under the lower surface of the rail 27 and is pushed downward by the rail 27.

In conjunction with the movement, the movable brake bar 16 withdraws to a position which avoids contact with the support film 13, making the support film 13 movable. At that time, a movable rod 17 of the inclined angle switching device 18 is protruded. The protruded movable rod 17 is brought into contact with the free end of the support film 13*b* in a movable state. The movement along the guide 19 changes the inclined angle of the support film 13*b*.

Thereafter, the inclined angle switching device 18 moves along the guide 19 and the pin 26 is returned to the uppermost position in accordance with the shape of the rail 27. When the movable brake bar 16 is conjunctively raised to restore the fixed position, the support film 13 is pushed and rotated by the movable brake bar 16 and its position is corrected to a desired maximum or minimum inclined angle.

The rail 27 controlling the up-and-down movements of the pin 26 may be a groove 28 as shown in FIG. 11C. The groove 28 is provided in a hollow shape along the travel line of the pin 26. Specifically, in conjunction with the traveling of the inclined angle switching device 18, the pin 26 of the movable brake bar 16 enters the groove 28 in a hollow shape. The positions of the pin 26 and movable brake bar 16 are moved up and down in accordance with the shape of the groove 28.

According to this embodiment, the movable brake bar 16 mechanically moves up and down in conjunction with the movement of the inclined angle switching device 18. The mechanism for moving the movable brake bar 16 up and down can be implemented without providing any electric mechanism. The up-and-down movements of the movable brake bar 16 with the mechanical mechanism result in reduced electricity being consumed for the change of image information.

Various modifications will become possible for those skilled in the art after receiving the teachings of the present disclosure without departing from the scope thereof.

What is claimed is:

1. A display device formed with an array of a plurality of pixels, the device comprising:

fixed elements with surfaces colored a first color, the fixed elements being arranged in correspondence with the pixels;

movable elements with surfaces colored a second color, the movable elements being arranged in correspondence with the pixels;

support elements supporting the movable elements at first ends thereof, the support elements being rotatable; and an inclined angle changing device configured to move while contacting second ends of the support elements to change the inclined angle of the support elements by having each of the support elements rotate about a fulcrum of the support element; wherein, changing the inclined angles of the support elements allows the movable elements to move between rear surfaces of the fixed elements and the adjacent front surfaces of the fixed elements.

2. A display device as set forth in claim 1, wherein the inclined angles of the support elements are adjustable in steps.

3. A display device as set forth in claim 1, wherein the movable elements are colored different colors, and the differently colored movable elements are assigned to each of the fixed elements.

4. A display device as set forth in claim 1, further comprising brake bars capable of fixing and maintaining the inclined angles of the support elements after the inclined angles of the support elements being changed.

5. A display device as set forth in claim 4, wherein the inclined angle changing device comprises a control mechanism configured to advance or withdraw the brake bars to or from positions capable of fixing and maintaining the inclined angles of the support elements, in conjunction with the movement of the inclined angle changing device along an array of the support elements.

6. A display device as set forth in claim 1, wherein the inclined angle changing device comprises a mechanism arranged in the vicinity of the second ends of the support elements to move along an array of the support elements, selectively changing the inclined angles of the support elements.

7. A display device as set forth in claim 6, wherein:

the inclined angle changing device comprises a movable rod configured to be able to protrude; and the movable rod is selectively protruded to be able to move while contacting the second ends of the support elements and rotate the support elements.

8. A display device as set forth in claim 6, wherein:

the inclined angle changing device comprises a rotatable cylindrical drum provided at a side surface thereof with at least one protrusion; and the protrusion is selectively able to move while contacting with the second ends of the support elements by the rotation of the cylindrical drum, to rotate the support elements.

9. A display device as set forth in claim 8, wherein the cylindrical drum is rotatable in both forward and backward directions with respect to the moving direction of the inclined angle changing device.

10. A display device as set forth in claim 8, wherein:

the rotatable cylindrical drum provided at the side surface thereof has two protrusions in symmetric positions with respect to a moving direction, each of the two protrusions is selectively configured to move while contacting with the second ends of the supports elements one after the other, to rotate the support elements.

11. A display device formed with an array of a plurality of pixels, the device comprising:

fixed elements with surfaces colored a first color, the fixed elements being arranged in correspondence with the pixels;

movable elements with surfaces colored a second color, the movable elements being arranged in correspondence with the pixels;

support elements supporting the movable elements at first ends thereof, the support elements being rotatable;

an inclined angle changing device configured to contact second ends of the support elements to change the inclined angle of the support elements; and brake bars configured to maintain the inclined angle of the support elements; wherein:

changing the inclined angles of the support elements allows the movable elements to move between rear surfaces of the fixed elements and adjacent front surfaces of the fixed elements; and the inclined angle changing device comprises a control mechanism configured to advance or withdraw the brake bars to or from positions enabling the maintenance of the inclined angles of the support elements, in conjunction with the movement of the inclined angle changing device along an array of the support elements.

12. A display device formed with an array of a plurality of pixels, the device comprising:

fixed elements with surfaces colored a first color, the fixed elements being arranged in correspondence with the pixels;

movable elements with surfaces colored a second color, the movable elements being arranged in correspondence with the pixels;

support elements supporting the movable elements at first ends thereof, the support elements being rotatable;

an inclined angle changing device configured to contact second ends of the support elements to change the inclined angle of the support elements; wherein:

changing the inclined angles of the support elements allows the movable elements to move between rear surfaces of the fixed elements and adjacent front surfaces of the fixed elements;

the inclined angle changing device comprises a mechanism arranged in a vicinity of the second ends of the support elements to move along an array of the support elements, selectively changing the inclined angles of the support elements;

the inclined angle changing device comprises a movable rod configured to protrude; and the movable rod is selectively protruded to be configured to contact the second ends of the support elements and rotate the support elements.

* * * * *